United States Patent [19]

Hudson

[11] 4,024,703

[45] May 24, 1977

[54] COMBUSTION IN COMBUSTION PRODUCTS PRESSURE GENERATOR INTERMITTENT BURNER TYPE AND ENGINES

[76] Inventor: Perry D. Hudson, 515 Delaine Drive, Corpus Christi, Tex. 78411

[22] Filed: Jan. 28, 1974

[21] Appl. No.: 437,462

Related U.S. Application Data

[60] Continuation-in-part of Ser. No. 189,444, Oct. 14, 1971, abandoned, which is a division of Ser. No. 34,302, May 4, 1970, Pat. No. 3,775,973.

[52] U.S. Cl. ..... 60/39.03; 60/39.25; 60/39.27; 60/39.51 R; 60/39.62; 60/39.81

[51] Int. Cl. ..... F02g 3/02

[58] Field of Search ..... 60/39.69, 39.7, 39.76, 60/39.8, 39.81, 39.62, 39.38, 39.27, DIG. 6, 39.21, 39.03

[56] References Cited

UNITED STATES PATENTS

| | | | |
|---|---|---|---|
| 2,341,257 | 2/1944 | Wunsch | 60/DIG. 6 |
| 2,404,395 | 7/1946 | Milliken | 60/39.69 |
| 2,829,493 | 4/1958 | Hobson | 60/39.21 |
| 3,088,276 | 5/1963 | Hudson | 60/39.76 |
| 3,364,971 | 1/1968 | Hayes | 60/39.82 R |

*Primary Examiner*—Carlton R. Croyle

*Assistant Examiner*—Robert E. Garrett

[57] ABSTRACT

This invention comprises improvements in combustion products pressure generators of the intermittent cycle, two stage type and reciprocating piston engines which use the combustion products the pressure generators produce for power to drive compressors which supply combustion air to the pressure generators. Improvements of the pressure generators include an improved type burner with forced air circulation and dilution of the hot gases with cooler air making for minimum air pollution.

Improvements in the mechanical seal on the fan shaft. Improvements in the means to drive the fan which include a pressurized cooled motor housing and improved drive shaft. Improved insulation, burner and fan construction. Improved fuel to air ratio and temperature controls, fuel cutoff on ignition failure. Improved cycle which operates the combustion products generators in multiples of three on a stop and go cycle which produces just the amount of hot fluid medium required by the prime mover. Improved mechanism to operate the combustion products generators in the improved cycle. This improved power system is designed for very high efficiency low fuel consumption and minimal air polluting emissions.

19 Claims, 23 Drawing Figures

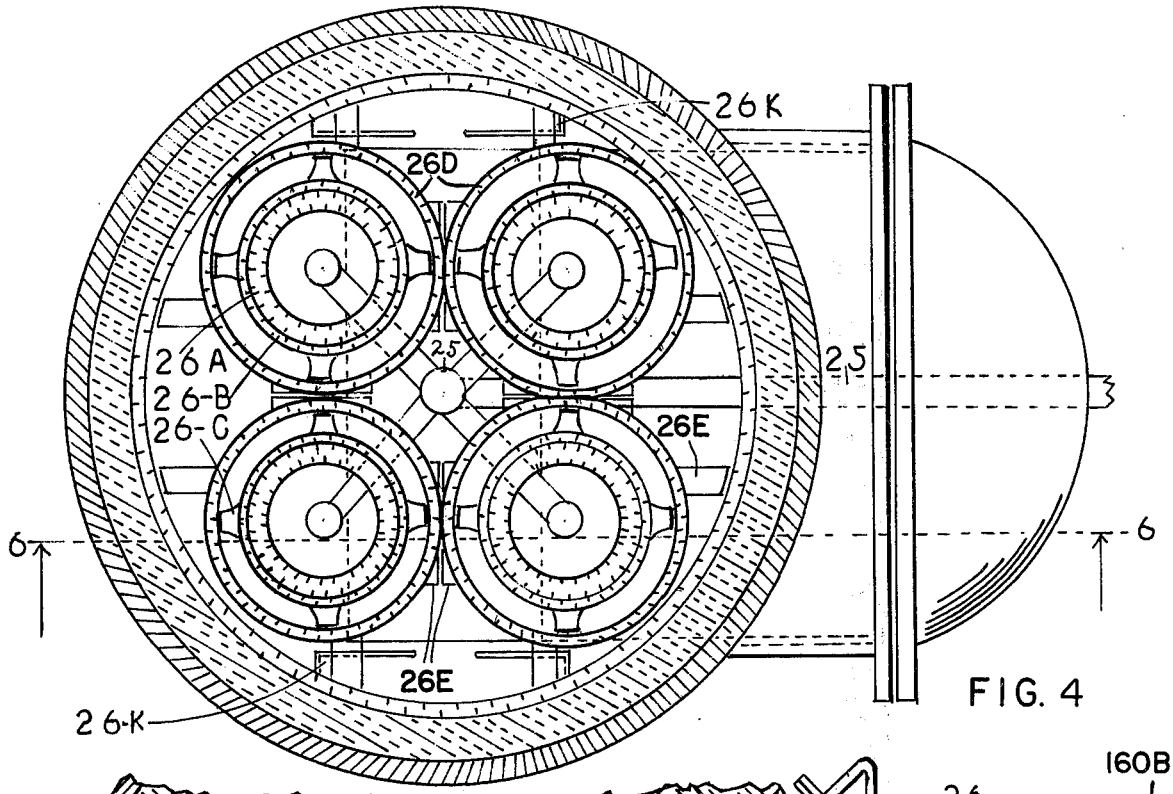
FIG. 4
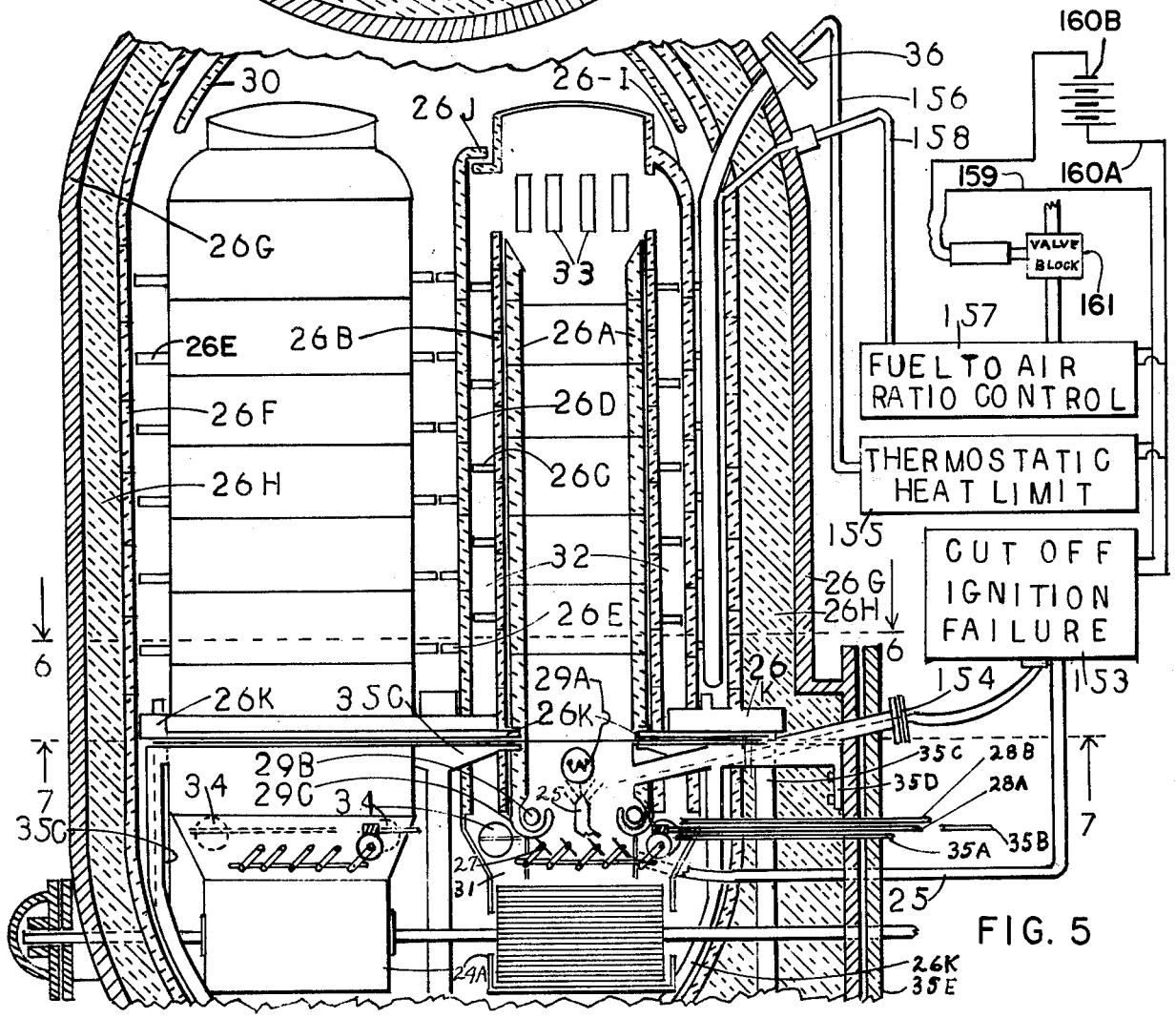

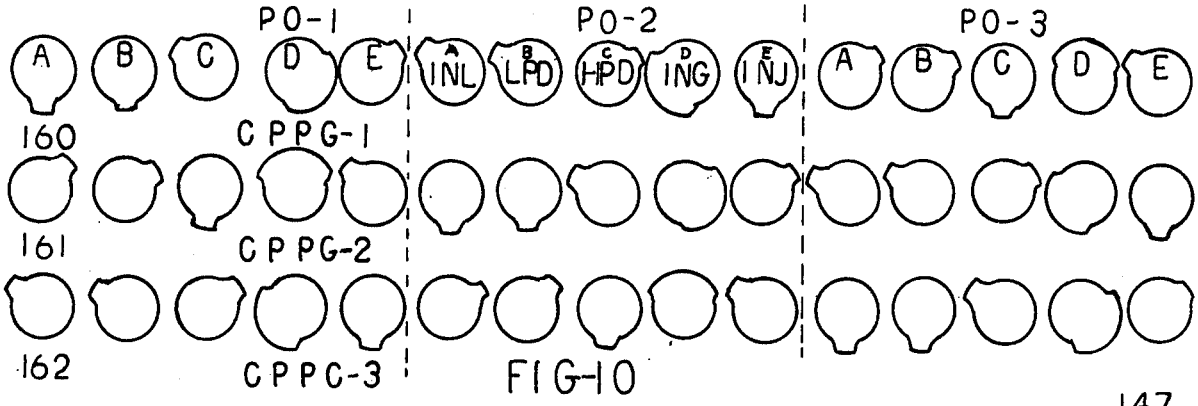
FIG-10
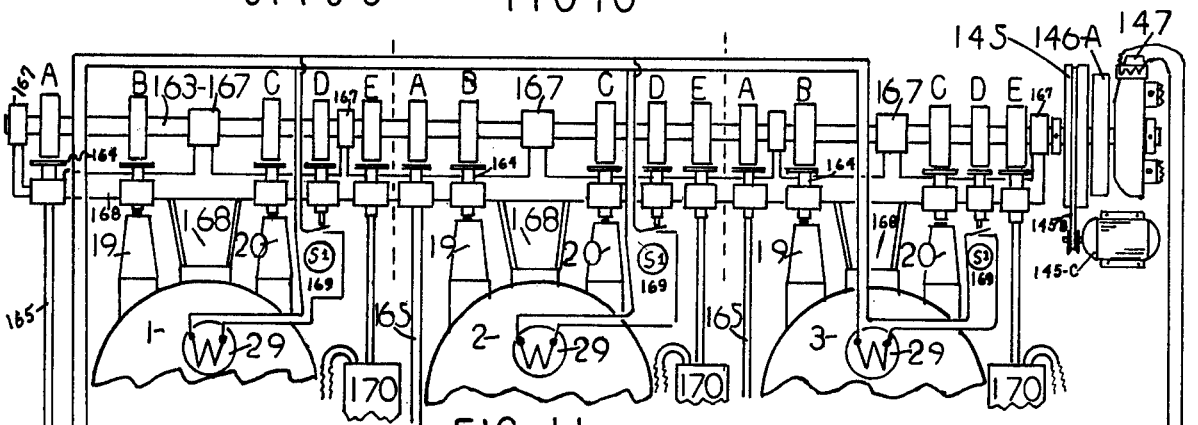
FIG-11
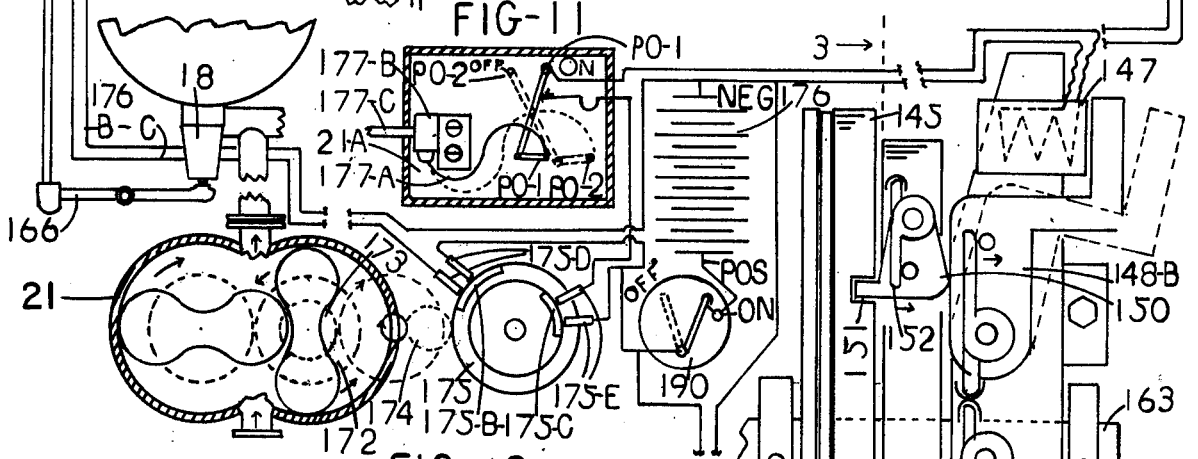
FIG-12
FIG-13
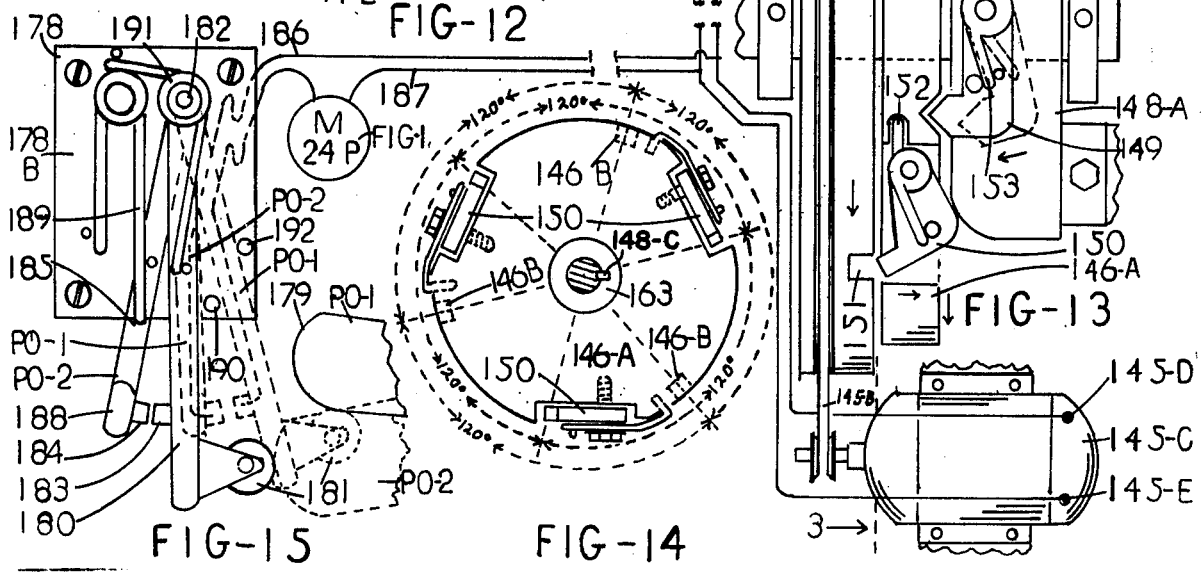
FIG-15
FIG-14

TO LINE-158

178
186
187
180
193
E
195-B
193
179
C
PO-1
PO-2
179-B
181
B
PO-1
PO-2
179-D
195-A
PO-1
PO-2
PO-2
PO-1
195-G
179-A
194
C
195-D
194-D
195-E
194-B
AIR
PRES
PO-1
PO-2
195-F
194-A
196-G
195-C
197-F
194 E
PO-1
PO-2
196-D
196-C
HEAT
PO-2
PO-1
197-E
196-B
199C
196-A
196-E
193
197-D
197-C
199-A
199-B
198-A
195-G
195-T
195M
195-J
195-K
195-R
195-I
195-L
197-A
195-S
195-P
195-E 193
197-B
198-G
198-H
198-B
198-C
198-E
198-D
198-F

TO LINE 156
195K
195-J
195-G
195-N
195-R
195-L
195-O
195-E
195-I

24-F
205
210
208
186
187

222-A
200-A
222-B
200-B
207
215
201
202
224
5
216
203
212
24-B
24-A
24-N
221-A
221-B
206
214
213
219
220
24-N
24-P
24-J
24
218
203
217
24-J
203
24-P
24-N
221A
221-B
219
24-O
204
222C
214
205
24-N
206
216
24-O
24M
24-F
24-K
212
210

223-D
223-C
223-B
215
5
209-211
210
205
223-A
CK
216
231-C
201
212
232-A
231-A
205
232-B
207
232-C
231-B
230
200
237
CK
230 A

24 F 5
4
229
4
233
24
24
234
236
229
226
227
225
235
238
230 A
3
230
205
5
3

COMBUSTION IN COMBUSTION PRODUCTS PRESSURE GENERATOR INTERMITTENT BURNER TYPE AND ENGINES

This is a continuation in part of application 189,444 filed Oct. 14. 1971, now abandoned, which was a divisional application of application 34,302 filed May 4, 1970, now U.S. Pat. No. 3,775,973.

This invention relates to heat engines of the pressure generator type having combustion chambers separate from the power cylinders or turbine. The combustion chambers are of sufficient volume capacity to supply hot gases under pressure to the power cylinders or turbine to operate said engine or turbine several revolutions to each cycle of each combustion chamber so as to enable ignition and combustion to be extended over any desired period of time, independent of the speed of the engine or turbine, thus giving the combustion within said combustion chamber time to reach a temperature whereby as near a complete combustion of the fuel is reached as possible. This should give minimum air pollution from the exhaust.

A further objective of this invention is to provide a way and means of dilution of said hot gases within the combustion chamber with air to reduce the temperature of the gases to workable temperatures.

A further objective of this invention is to provide improved pressure generators which can be operated at full load charge to light loads through to full loads. This maintains near perfect combustion conditions as to temperature, pressures etc. with near complete combustion and great economy. This is accomplished by changing the number of cycles per minute in ratio to the load the pressure generator is operating at rather than a lighter or heavier fuel charge per cycle. This is an advantage where the load or both load and speed, varies widely, such as vehicle propulsion, and also saves on the amount of compressed air used on light loads.

With two-stage pressure generators, best results are obtained by using three pressure generators operating in rotation, alternating in the steps of the cycle to supply the engine or turbine a steady supply of pressure fluid medium in both the high and low pressure ranges. This arrangement also gives several seconds of time for the burning of the fuel to heat the air, which makes for good clean combustion. While overall efficiency is higher with higher compression, 600 PSI to 1500 PSI may prove to be the most practical area of operating pressures. As an example in this specification, I am using 600 PSI as the compression pressure.

A further object of this invention is to provide a four cylinder reciprocating piston engine described to work on high temperature fluid medium at two pressure levels simultaneously, from a two-stage pressure generator. Said engine has one high pressure and one low pressure double acting cylinder for the higher range pressure fluid medium, and one high pressure cylinder and one low pressure double acting cylinder for the lower range pressure fluid medium.

A further object of this invention is to provide a reciprocating piston engine designed to handle high temperature gases without lubrication, consisting of the piston having carbon or other anti-friction material in the power piston rings and rod seals, a means of maintaining the cylinder wall at the highest possible workable temperature, and a means to control and maintain that temperature, thereby making possible minimum heat loss from the pressure fluid medium to the working parts of the cylinder.

A further object of this Invention is to provide a reciprocating piston engine designed to operate on high temperature gases which has valves in the cylinder heads so as to cut the clearances losses to a minimum.

A further object of this invention is to provide a reciprocating piston engine with extra large valve openings and extra large manifolds to cut pressure fluid medium moving friction to a minimum.

A further object of this invention is to provide a reciprocating piston engine with a automatic variable cut off of the pressure fluid medium inlet with a range of, "off to 50%" of the stroke on the high pressure cylinders. This makes maximum use of the expansion of the hot gases. The cut off can be used as a throttle valve or connected to a variable speed governor, thereby making for great economy of the consumption of the pressure fluid medium. When used on a vehicle, the off piston of the cutoff enables the engine to be used as a brake when the vehicle is running or coasting. Friction brakes would have to be used to stop and hold the vehicle stationary.

A further object of this invention is to provide a variable capacity air compressor to supply combustion air to the pressure generators. This is done by using single acting compressor pistons in place of cross heads on each of the four power cylinders, a large diameter, low pressure air compressor piston on each of the low pressure power cylinders, and a smaller diameter, high pressure compressor piston on each of the high pressure power cylinders. This makes two two-stage air compressors which can be used one at a time or both together in parallel, and are controlled by an automatic unloading system and a variable clearance means on the low pressure cylinders to make a wide variation possible in capacity. This makes it possible to compress just the volume of air needed to suit the load and speed. With the vehicle or driver controlling the unloading system, the compressors make a powerful running or coasting braking system.

A further object of this invention is to provide an automatic or manual means to start the engine as a simple throttle controlled engine, and then at a predetermined speed or RPM to change the operation to an automatic cutoff engine, or, in the case of a multiple cylinder compound engine, start as a multiple cylinder simple engine, and at a predetermined RPM automatically or manually change operation to a automatic cutoff compound engine. This feature makes it possible to start the engine from a cold start smoothly and with great power, and can be used as a low gear when greater power is needed.

A further object of this invention is to provide a combined reciprocating piston engine and air compressor designed to supply combustion air to pressure generators, and use the hot pressure fluid medium produced by them to drive vehicles or other work. The engine employs a preheater using the hot exhaust from the engine to preheat the combustion air before it enters the pressure generators, thereby saving on the fuel required to heat the air in the pressure generators. This saves about 50% of the fuel. The preheaters should heat the combustion air to about 800° F.

A further object of the invention is a power plant incorporating all the aforementioned features into a very versatile, economical, and virtually pollution free power producing unit.

A further objective of this invention is a seal cooling and blocking system for the shafts that drive the fans inside the pressure generators, and for the throttle valve operating shafts, to effectually seal the hot gases in, to provide a means of keeping the hot gases away from the seals, and to provide a means of cooling the seals themselves.

FIG. 1 is a schematic view of a four cylinder double acting reciprocating piston engine with air compressor pistons in place of cross heads. This engine is designed to use pressure fluid medium generated in pressure generators and supply said pressure generators with combustion air. This engine is designed to drive automotive vehicles or other works. This drawing shows the flow of the compressed air from the compressor cylinders to the pressure generators on the left and back to the power cylinders.

FIG. 4 shows a cross section plan view of FIG. 5 on lines 6—6 of a four-burner combustion products pressure generator shown in elevation in FIG. 5.

FIG. 10 shows a schematic side view in elevation of the position of the valve ignition and fuel injection cams on all three combustion products pressure generators of FIG. 1 in all three positions PO-1, PO-2, and PO-3. All cams turn clockwise.

FIG. 11 shows the three combustion products pressure generators, and an overhead camshaft for operation of the valves.

FIG. 12 shows a view in elevation and in section of a Roots blower type positive displacement meter, which drives, through a reduction gear train, an electric contact drum which controls the stepping forward of the camshaft one third revolution when the pressure generator that is filling with fresh air has completed filling.

FIG. 13 shows a plan view of the camshaft driving mechanism, which works in cooperation with the volume meter and contact drum mechanism shown in FIG. 12.

FIG. 14 is a side view in elevation of the camshaft operating fly wheel, taken on section lines 3—3, FIG. 13.

Figure 1:
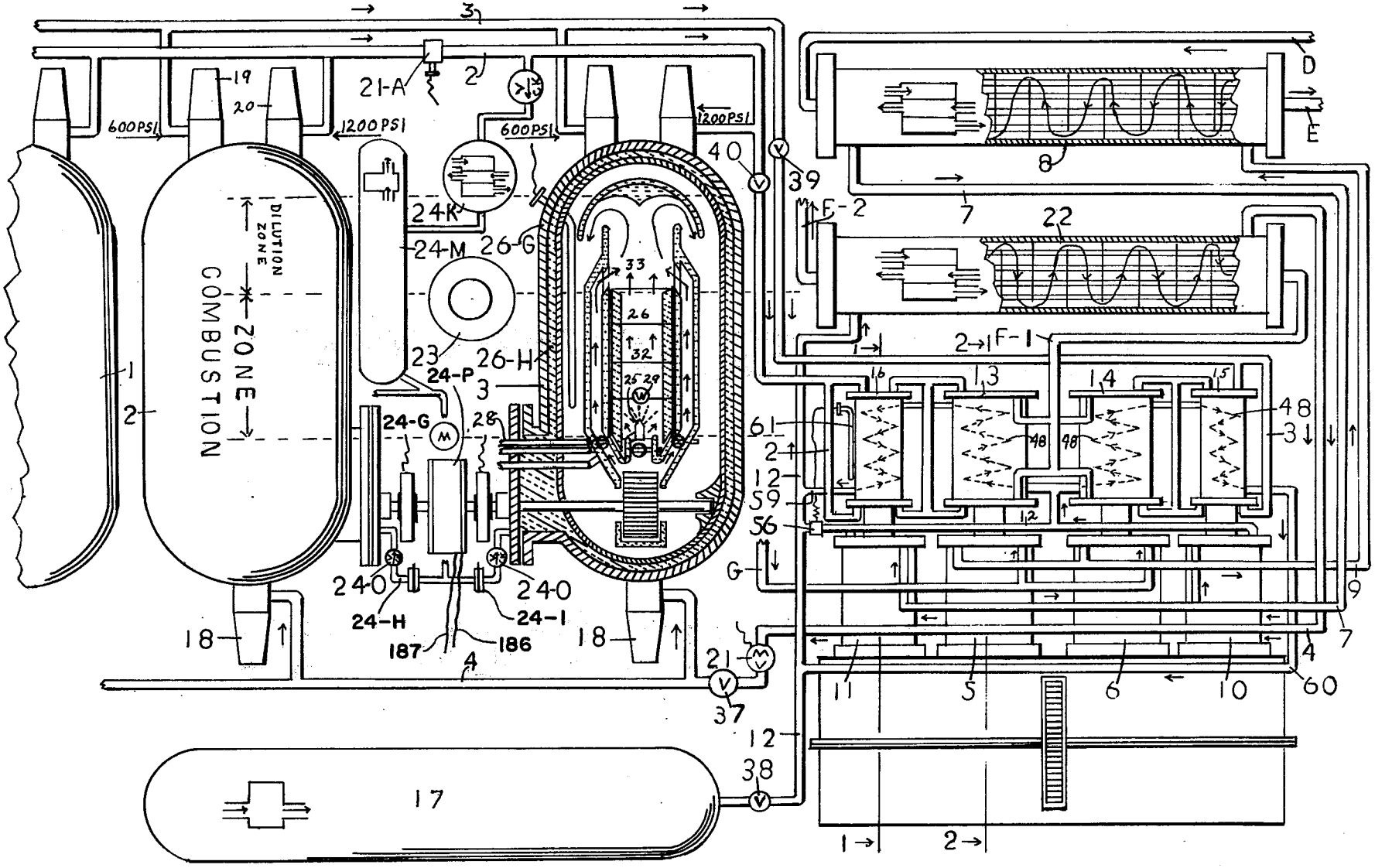
Figure 3:
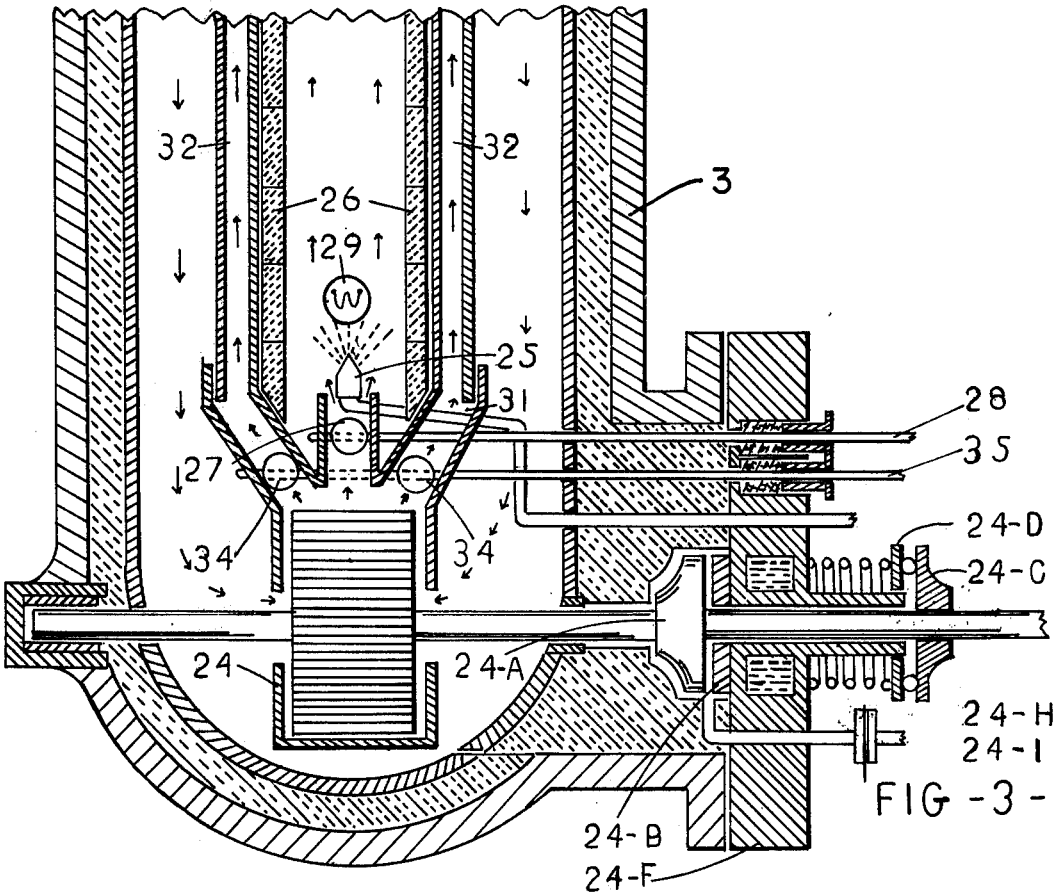
FIG. 3 is a sectional view in elevation showing the lower part of the pressure generator circulating fan and burner construction shown in FIG. 1.
Figures 5, 16, 17, 18:
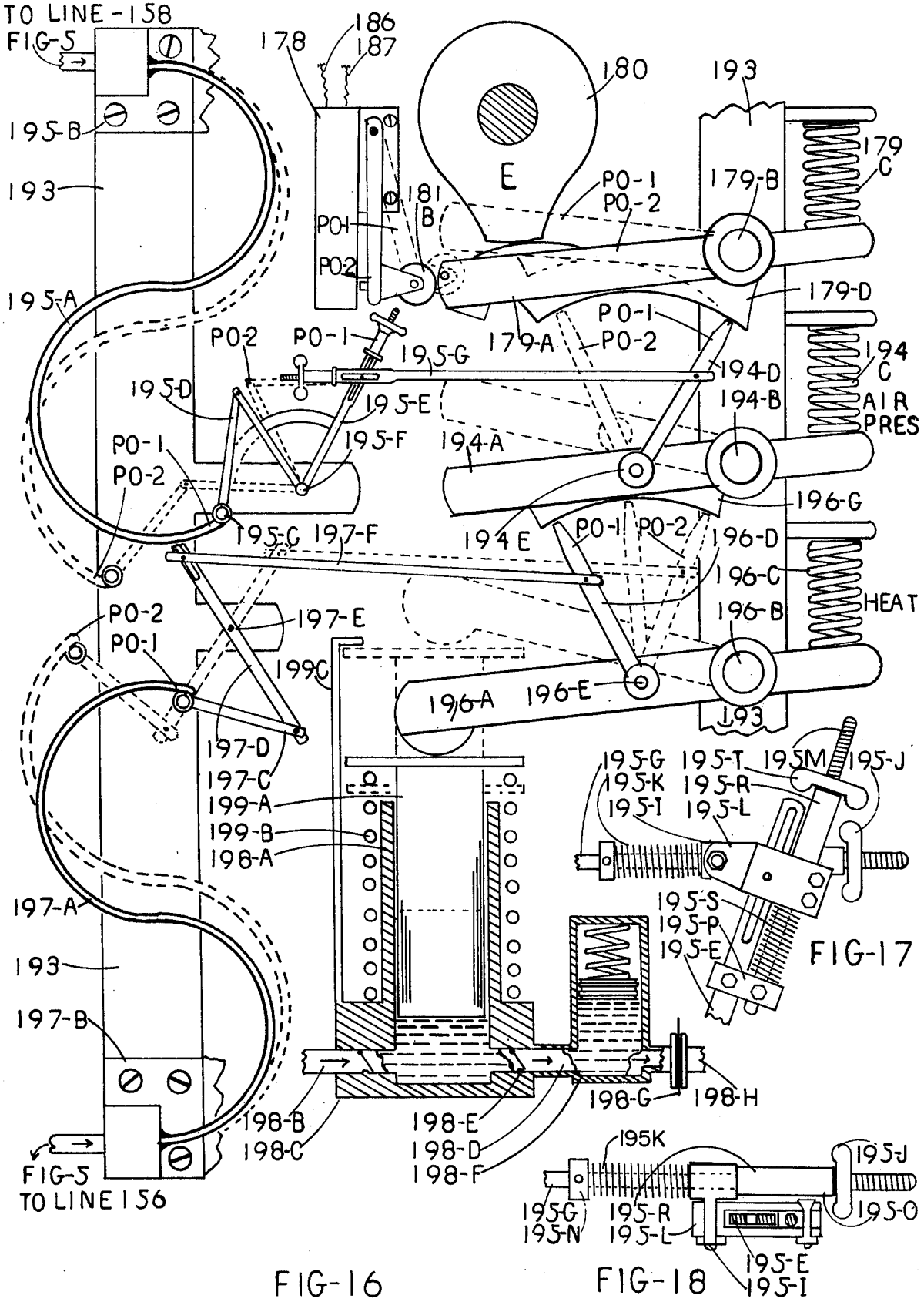
FIG. 5 shows a cross section in elevation of the four-burner combustion products pressure generator on section lines 6—6 of FIG. 4.
FIG. 16 is a schematic view, part on section, of the fuel injector and controls which limits the temperature inside the pressure generator, and the fuel to air ratio to the burners.
FIGS. 17 and 18 are views of the calibration adjustments for the controls.

FIGS. 19, 20, 21, 22 and 23 are views showing an alternate construction of the mechanical seal and the drive motor of the circulating fan 24 shown in FIGS. 1, 3 and 5.

Figure 2:
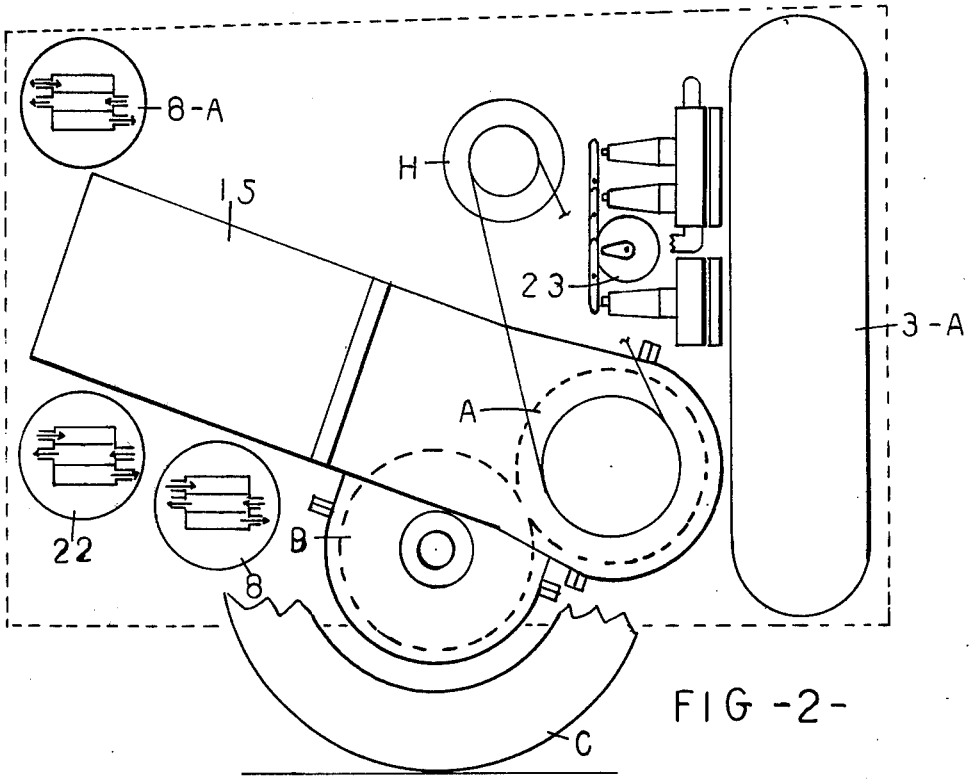
FIG. 2 is a schematic side view in elevation of the engine in FIG. 1 installed in a automotive vehicle to drive either the front or back wheels. The dotted lines represent the space limits in a 1969 automobile engine compartment.

Refering to the drawings, FIG. 1 is a schematic side view in elevation of a four cylinder, double acting, reciprocating piston engine. FIG. 2 is an end view of the same engine mounted in a vehicle with direct gearing to drive axles for either front or rear axle drive. The main drive gear or sprocket A. FIG. 1 and 2, is mounted in the center of the engine crankshaft and engages main drive gear or sprocket B, FIG. 2, on the differential, which in turn drives the wheels C, FIG. 2, via a drive axle for the case of a front wheel drive with conventional universals and steering mechanism. The cooling medium to the interstage cooler 8, FIG. 1, comes in line D and flows through the cooler and out line E to the radiator or other source of cooling medium. The low pressure air from the low pressure compressor cylinders 5 and 6 goes to the interstage cooler via line 9 and returns to the high pressure compressor cylinders 10 and 11 via line 7. The combustion air preheater is 22. The exhaust comes into the tube side from the low pressure power cylinders 13 and 14 via line F-1 and out of the preheater via line F-2 to the consenser 8-A, FIG. 2, where all the condensables will condense out of the exhaust, thereby cutting down on the pollution emissions.

The high pressure air from the high pressure compressor cylinders 10 and 11 goes to the left-hand end of the shell side of the preheater via line 12, and through preheater 22 where hot exhaust from the low pressure power cylinders 13 and 14, via line F-1, preheats the combustion air to approximately 800° F, and thence to the pressure generators via line 4 to the inlet valves of the pressure generators 1, 2 and 3 at approximately 800° F. The intake to the compressors is through line G. The accessory drive of FIG. 2 is H, which drives the electric generator, air conditioner compressor, etc. The pressure generator 3-A, in FIG. 2, has a slightly different valve location for the intake and exhaust valves, and camshaft of the pressure generator, which makes liquid cooling of the valves easier, and makes the pressure generator shorter in length for automobiles or other installations.

Referring to the drawings, in FIG. 1, air receiver 17 is supplied through line 12. Receiver 17 floats on the line and stores a reserve supply of compressed air for starting purposes and very slow engine operation when the compressor would not be compressing air. This also keeps a constant pressure on the pressure generators being charged, and pushes the low pressure expanded gases out of the pressure generators at 600 PSI for useful work.

Whenever two-stage pressure generators are used, three two-stage pressure generators must be used to get a steady flow of pressure fluid medium to the engine or turnbine at all times.

FIG. 3 is a cross section of the lower part of one of the pressure generators. The operation of this burner will be explained in detail later. The fan 24 drive shaft has a mechanical seal where it comes out of the pressure vessel. The fan drive shaft has a seal — plate plate 24A secured to and turning with it. The seal plate is a hard, highly polished metal which bears against seal plate 24B which is, carbon or other antifriction material secured to head 24F.

The pressure flange 24C is secured to, and turning with, the shaft, which has a ball or roller thrust bearing. Bearing 24D is held against flange 24C by spring 24E, which hold flange 24A tightly against seal plate 24B, making a pressure tight running seal.

To keep the hot gases away from the seal, a small quantity of cool high pressure air is injected around the seal and pushes the hot gases back into the combustion chamber around shaft 24. This air comes through line 24H, and is controlled by orifice plate 24-I. This air could come from the 1200 PSI line 2, FIG. 1, which is the high pressure discharge line from the pressure generators, through a check valve 24-J, through a cooling exchanger 24-K, into receiver 24-M, out through line 24-N through orfice 24-I, FIGS. 1 and 3, into lines 24-H through check valves 24-Q, FIG. 1, and into seals 24-A and 24-B, FIG. 3. As the pressure in the 1200 PSI discharge manifold, line 2, FIG. 1, is above the pressure working pressure two thirds or more of the time, this would give effective blocking of the hot gases from the seal area. An extension of line 24-N would go to number 1 pressure generator and to the seals on throttle valves 111, 112, 113, and 114, FIG. 9, and the throttle valve 112 as shown in FIG. 10.

The magnetic clutches to start and stop fans 24 are 24-G, FIG. 1, and are controlled by timer 23, FIGS. 1, 6, 10, 11, 12, 13, 14, and 15.

Describing the construction of the burners and fans of the pressure generators shown in FIGS. 1, 3, 4, and 5, number 25 is the fuel spray nozzle and supply line. Number 26A is the very high temperature refractory material liner of the right hand burner, which fits loosely into the inner burner barrel 26B.

The heat resistant material inner burner barrel is 26B, which has radial extending spacing legs 26C that hold outer burner barrel 26D spaced for passage upward of the dilution air 32, which goes into the hot gases from the burner through aperatures 33, FIGS. 1, 4, and 5.

Number 26D is the heat resistant material outer burner barrel, which has radial extending spacing legs 26E that rest against heat resistant material inner liner 26F of the pressure vessel 26G, which has a thick coat of insulation 26H inside between the pressure vessel and inner liner 26F. The top section 26H, which has the dilution air apertures 33 into the inner burner barrels, and the top section of the inner and outer burner barrels can be made integral, as shown in 26-I, or with a simple slip joint shown as 26J.

In smaller sizes, the inner burner barrels 26B, outer burner barrels 26D, and inner liner 26F for the pressure vessel might successfully be made of heat resistant metal. However, the ceramic or refractory material would be cheaper and probably stand up better. Ceramic or refractory material is shown in FIGS. 4 and 5, made in concentric rings, and stacked loosely as shown. Clearance is allowed between 26 A and 26B for expansion, and between spacer legs 26C and 26D, between spacer legs 26E and the adjoining burners and the inner liners 26F for expansion. These ceramic and refractory material rings or sections could be cheaply made by casting in molds or pressed by dies.

The burner barrel assembly is supported by frame 26K, FIGS. 4 and 5. This frame is supported by legs 26K, FIGS. 4 and 5, which rest on the bottom of the inner lining 26F, which in turn rests on insulation 26H, and this insulation rests on the bottom of the pressure vessel 26G. Thus the burner assembly, above line 7—7, is supported by frame 26K, and below line 7—7 is supported on frame 35C, which is secured to removable inspection head 35C. Therefore, when head 35C is unbolted, the whole assembly below line 7—7 slides out for inspection and repair, including the fans, spray nozzles, and ignition means.

In FIG. 5, 29A is the electric heated glow coil ignitor, and 29B is the alternate glow coil situated in catch basin 25C, which catches excess fuel when making a cold start. The heat from glow coil 29B vaporizes and ignites the fuel. The combustion air to the burner is regulating by damper 27, which is operated from outside of the pressure generator by control rod 28A or 28B via a worm gear as shown. Number 31 is the dilution air passageway from the fan 24 into dilution air jacket 32, through apertures 33 and, into the hot gases from the burner. The dilution air control dampers are 34, which are operated from outside the pressure generator by control rods 35A or 35B. Number 30 is the hot gas and flame divertor.

In FIG. 5, a conventional cutoff upon ignition failure is shown as 153, and is controlled by a photo cell 154. Number 155 is the conventional thermostatic heat limit control, which connects to the thermostatic element 36 inside the pressure generator by capillary tubing 156. Number 157 is the conventional fuel to air ratio control connected to the pressure generator by pressure connection 158. The cutoff is operated via wires 159 and 160-B and battery 160-A, FIG. 5.

Figure 6:
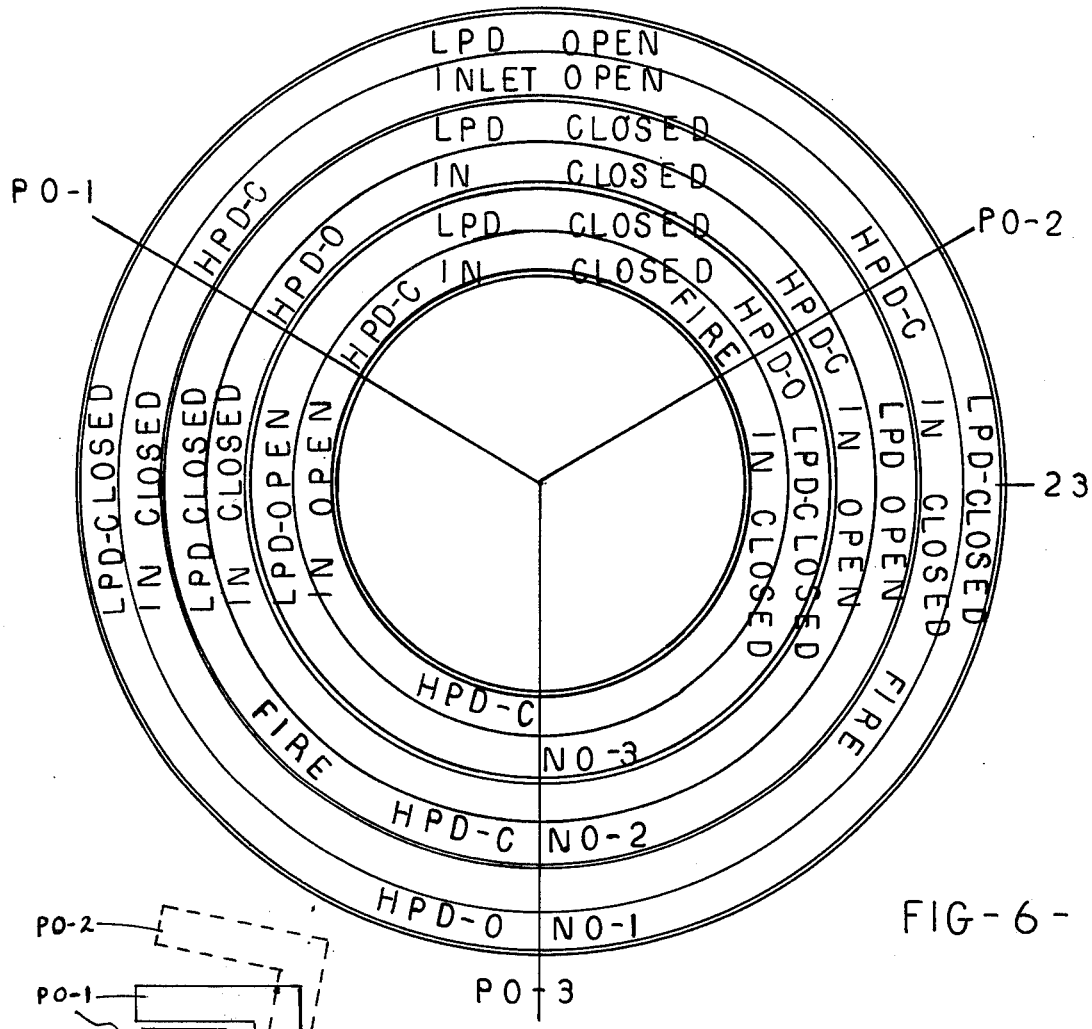
FIG. 6 shows the cycle timer of 3 two-stage pressure generators operated with an engine or turbine.

Please refer to FIG. 6 for the timing of the valves on the two stage pressure generators. These generators can be made in any desirable size. These pressure generator cycles and explanations are based on one half cubic foot per cycle volume displacement capacity, with the pressure generators using 10.7 cubic feet at 100° F. free air compressed to 600 PSI and preheated to 800° F after compression, as a charge. This charge, when heated to 1600° F in the pressure generator, would give a pressure of 1158 PSI.

Describing the cycles and valve timing controlling the same, refer to FIG. 6, position 1, pressure generator 1, the high pressure discharge valve is closed, the low pressure discharge valve is open, and the inlet valve is open. The gases within pressure generator are 1600° F and 600 PSI, 800° F. The inlet air from the bottom pushes the hot gases out through low pressure discharge valve 19, into the engine intake manifolds via line 3, and into engine cylinder 15, FIG. 1. The incoming air being cooler stays on the bottom and pushes the hot gases up and out until volume meter 21, FIGS. 1 and 12; signals that the pressure generator is full of fresh air. This signal, electric or mechanical, together with the electric or mechanical signal from the pressure switch 21-A that the pressure in the high pressure manifold 2 has dropped to 650 PSI, act together, via electric solenoid 147, to trip catch 150 on timer 23, FIGS. 1, 2, 6, 7, 8, 10, 11, 12, 13, and 14, and moves the timer and valve operating camshaft to PO-2. The cam on the timer shaft closes both the low pressure discharge and inlet valves on pressure generator 1, blocking in the fresh air at 600 PSI and 800° F. This timer action lights burner 25, FIGS. 1 and 3, 4, and 5, by spraying into the hot air an exactly measured amount of fuel at a measured rate of flow against the hot refractory material 26, FIG. 3, 4 and 5 (cold start ignition is by spark plug or glow plug 29). Fan 24 is started to give a flow of combustion air through the burner. This flow is regualted by damper valve 27, actuated from the outside of the pressure generator by shaft 28. Properly regulated, this burner should burn hot enough to make a clean burn, that is, burn up all the elements that pollute the air, as clean as possible. The 800° preheat air plus 3500° to 3800° combustion should burn all there is that will burn. The burner is regulated to produce a short hot flame so that no flame reaches divertor 30, FIG. 1, at the top of the burner. The outlet of the fan 24 is divided so that part of the air is diverted up passageway 31 into burner jacket 32, where it goes to the top of the burner and goes into the stream of combustion products coming out of the burner through openings 33—33, cooling them down to workable temperatures. This flow of cooler air is regulated by dampers 34 on shaft 35. The burner is shut off by thermostatic element 36 when 1600° F is reached, or by the measured amount of fuel being consumed. The fuel is to be injected by a metering plunger pump, such as used on diesel engines, and has an adjustable stop to control how much fuel is injected. Also, an automatic means to adjust the amount of fuel injected in ratio to the amount of air in the pressure generator, consisting of a piston or diaphragm loaded with an adjustable spring tension acting against the air pressure in the pressure generator, is employed. As the amount of air is know, and the temperature rise needed is known, then the exact amount of fuel is injected to heat that quantity of air that many degrees F.

Thus, when combustion is completed and the air is at the required temperature, the timer awaits the signal that the engine has consumed the high pressures gases from pressure generator 3, and the pressure within manifold 2 has dropped to 650 PSI. When this occurs, then the timer moves to PO-3, the high pressure discharge valve is opened to manifold 2, and pressure generator 2 is fired. This system furnishes the engine the hot gases under pressure when and in what quantity needed. If the engine is stopped, the pressure generators wait with pressure ready. When the starting key switch is turned off to shut down the engine, the solenoid or pneumatic operated block valves 37, 38, 39, and 40 are closed automatically, blocking in the pressure generators and the air accumulators, and automatically opening bleeders on each engine cylinder to stop creep from possible leaky throttle valves.

Thus there are two pressure generators with 600 PSI, and one pressure generator with somewhere between 650 and 1100 PSI, less what ever cooling and leakage around pressure generator valve stem seals has occured, plus the 1 CU FT accumulator full of cold air at 600 PSI to start up on. When starting hot, this should give 3½ CU FT in the pressure generators, plus 1 CU FT in the accumulator, for a total of 2½ CU FT of gases to start on. If cold, it would be somewhat less.

Thus, when starting cold, there would be enough pressure there to move the engine, with load, several hundred revolutions without pressure generator firing. However, when the starting switch key is turned to the on position, for cold start, the pressure in the high pressure manifold would be down, so the pressure switch 21A to the timer turning means would be closed, and the timer would turn to the next position, firing the pressure generator which is ready to be fired. As the pressure in the high pressure manifold would still be down, the timer would move to the next position, firing the next pressure generator standing ready. In this number 2 position from cold start, the high pressure discharge valve on the pressure generator in number 1 would be opened to the high pressure manifold, thus raising the pressure in the high pressure manifold and opening the high pressure timer accuating switch 21-A until such time as the pressure falls down below the predetermined point of 650 PSI. In this case a timer relay switch would close the circuit around meter switch 21 for a period of 1 to 2 minutes to allow warm up time on the engine, etc.

Figure 7:
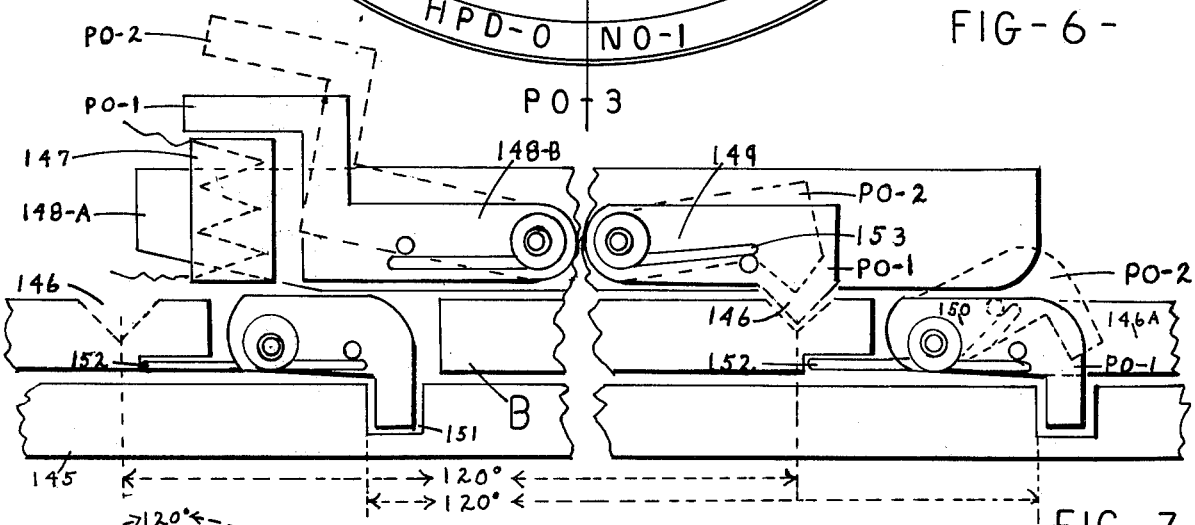
FIG. 7 is a flattened out view of the two-stage valve, fuel, and ignition timer operating wheel for a two stage pressure generator.
Figure 8:
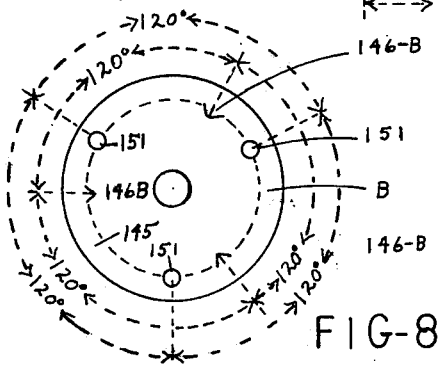
FIG. 8 is and elevation view of the face of the timer driven wheel.

FIGS. 7 and 8 show the mechanism which turns the valve and fuel cams one third turn on a signal from pressure switch 21-A, FIG. 1.

FIG. 7 is a flattened out top view of the power fly wheel 145, which turns at a constant speed of 20 to 50 RPM, and is driven by an electric motor or other means. The timer camshaft operating fly wheel is 146-A, which turns clockwise one-third of a revolution for each step of the operation of the three pressure generators. The stationary bracket holding the solenoid 147 and catch engaging mechanism is 148A, which supports catch engaging mechanism 148-B and holding stop latch 149. When the pressure switch 21-A, FIG. 1, on high pressure, pressure fluid medium line 2, closes, signaling the pressure has dropped to a predetermined point, this energizes solenoid 147, which draws lever 148B down from PO-2 (position 2) to PO-1 (position 1), striking latch 150 and forcing it into hole 151 in the face of flywheel 145, which is turning to the right clockwise. This puts pressure on holding catch 149, forcing it into PO-2 and disengaging it from 146. Stationary bracket 148 is spaced from flywheel 146-A and covers enough of the flywheel circumference to keep catches 150 engaged in the flywheel 145 for one-third of a revolution. The back side of catches 150 slides against the face of the bracket 148, which holds it engaged with power flywheel 145 until it emerges from the right hand end of bracket 148, and at which time spring 152 urges catch 150 from PO-1 to PO-2. At this time one of the stop notches 146B indexes with catch 149, and spring 153 forces catch 149 from PO-2 to PO-1, stopping and holding cam flywheel in PO-2.

There are three number 150 latches on cam flywheel 146A, positioned 120 degrees apart in line with the latch holes 151, FIG. 7, 8 & 13, in power flywheel 145, FIG. 8, and there are three number 146B stop notches in cam flywheel 146A spaced 120 degrees apart. Thus the valve, fuel, and ignition timer is turned according to the chart, FIG. 6, and moved from PO-1 to PO-2 to PO-3 and back to PO-1 to start all over again.

Figure 9:
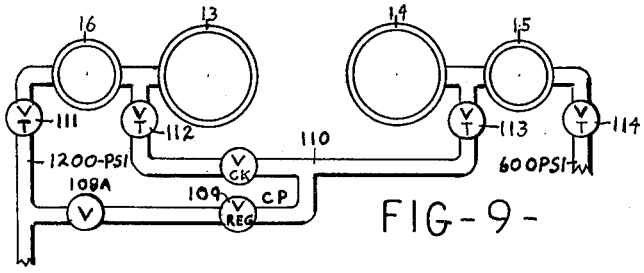
FIG. 9 is a plan view of the engine shown in FIG. 1, showing the throttle valves and the automatic bypass arrangement for simple engine start, which can be changed manually or automatically, to a compound engine.

FIG. 9 is a plan view of the engine shown in FIG. 1, showing the throttle valves and the automatic bypass arrangement for simple engine start, which can be changed, manually or automatically, to a compound engine.

FIG. 10 shows a side view in elevation of the position of the valve, ignition and fuel cams on all three combustion products pressure generators, FIG. 1, in all three positions, PO-1, PO-2, and PO-3. All cams turn clockwise. Number 160, in the top row from left to right, shows the position of the cams for pressure generator number 1 in all three positions number 161, center row, left to right, shows position of the cams for pressure generator number 2 in all three positions. Number 162, bottom row, from left to right, shows the position of the cam for pressure generator number 3 in all three positions. Cam A operates the inlet valve. Cam B operates the low pressure discharge valve. Cam C operates the high pressure discharge valve. Cam D operates the ignition switch. Cam E operates the fuel injector and the fan switch. When the position of the cam lobe is pointed down, that valve is open. For example, number A cam in PO-1 on pressure generator number 1 shows that the inlet valve on the pressure generator is open, cam B in PO-1 on pressure generator number 1 shows the low pressure discharge valve is open. Cam number C shows that high pressure discharge valve is closed. Cam D shows the ignition is on when using a glow plug for ignition. The ignition turns on a step ahead, so that the plug is hot, and cam E shows the injector cam ready to inject fuel in next step in PO-2. All cams turn clockwise in FIG. 10.

Going to PO-2 for pressure generator number 1, top row center, cam A inlet is closed, cam B low pressure discharge is closed, cam C high pressure discharge is closed, cam D, glow plug ignition is on, cam E injection and burn taking place, and the is on. Fan 24 operates during the burn period only, circulating air through the burner and dilution air into the hot gases for combustion, cooling them to workable temperatures.

Going to PO-3 for pressure generator number 1, top row, right hand side. Cam A inlet is closed, cam B low pressure discharge closed, cam C high pressure discharge open, cam D, ignition off, cam E, fuel injection off, fan off. The same sequence of operation takes place in pressure generator 2 and 3. Pressure generator 2 is two steps ahead of pressure generator 1. Pressure generator 3 is just one step ahead of pressure generator 1, as shown in the diagram in FIG. 6.

FIG. 11 shows the three pressure generators in a row, left to right, 1, 2, and 3, with an overhead camshaft 163, which is supported by bearings 167, which are carried by supporting members 168. This camshaft opens the pressure generator with valves 18, FIGS. 1, 10, and 11, via cam A, mushroom tappets 164, push rod 165, and rocker arm 166. Cam B opens low pressure discharge valve 19 via tappet 164. Cam C opens the high pressure discharge valve via tappet 164. Cam D operates ignition switch 169 via tappet 164. E Cam operates fluid fuel injection pump 170 via tappet 164.

FIG. 12 shows positive displacement meter 21 of the roots blower type which meters the fresh combustion air into the pressure generators. As the rotator rotates and meters the air into the pressure generator, it drives a spur gear train 172, 173, and 174, which rotates electric contact drum 175 one complete revolution to each pressure generator full of fresh combustion air. This contact drum turns clockwise, so contact is made for the ignition before the fuel is injected. The electric contact drum is made of a non conductor material and has metal contact segments 175B and 175C set in the surface of the outside diameter. Carbon contact bushes 175D make contact through metal segments 175B, completing the circuit from the battery 176, or other source of electrical power, via electric lines 176B and 176C to the ignition glow plug 29, or spark plug, in the pressure generator on which the ignition switch 169 is closed. These are spring release, single pole switches which are closed at the proper time by one of the D cams, and open upon release.

When carbon contact bushes 175E make electric contact across segment 175C, this completes the circuit from the battery 176 to pressure switch 21A, FIG. 1, which moves from PO-2 or OFF to PO-1 or ON when the high pressure manifold drops to 650 PSI, completing the circuit through solenoid 147, FIGS. 7, 8, 11 & 13, which draws arm 148B from PO-2 to PO-1, striking latch 150, forcing it into hole 151 in face of flywheel 145, turning camshaft 163 one-third of a turn clockwise. If the pressure in the high pressure manifold is above 650 PSI, the timer waits until the pressure drops to complete the circuit. A secured alternative method of controlling the timer camshaft timer could be used, eliminating the pressure switch 21A, and using the meter contact drum alone to complete the circuit to solenoid 147. A third alternative method of controlling the camshaft timer could be used eliminating the meter contact drum and using the pressure switch 21A alone to complete the circuit to solenoid 147.

The pressure switch 21A, FIGS. 1 and 11, is actuated by the pressure in the high pressure discharge line 2, FIG. 1, via pipe connection 177C, expanding the expansion tube 177A from PO-1, no pressure, to PO-2, 650 PSI or higher pressure. The expansion tube 177A is anchored to bracket 177B. The expansion tube 177A is an enlarged version of the bourbon tubes used in pressure gauges and pressure recording instruments. Number 190 is the master switch to start or stop the engine. The switch which starts and stops the the circulating fan 24, FIGS. 1 and 3, inside the pressure generator is 178, FIG. 15.

FIG. 13 shows an enlarged plan view of the timer operating wheel 23, FIGS. 1, 7, and 8. The camshaft is 163, FIGS. 2, 10, 11 and 12. The support bracket 148A supports solenoid 147. The actuating arm is 148B. The stop latch is 149, and the left-hand side of 148-A serves as a guide to hold latch 150 engaged. Cam operating flywheel 146A is keyed to camshaft 163 and carries three latches 150, as shown in FIGS. 7, 13 and 14. These latches are held in PO-2, FIG. 7, by spring 152 when not in PO-1 or engaged with the power flywheel 145, which is turned at a constant speed of 20 to 50 RPM by belt 145B and electric motor 145C, FIGS. 10 and 12. Motor 145C is activated by electric wires 145D and 145E from master switch 190, FIG. 11, when the switch is in the ON position.

FIG. 14 shows a view in elevation of the camshaft flywheel 146A, FIGS. 7, 10, and 11, on section lines 3—3 of FIG. 13. Viewed from the left, this shows the three latches 150 set in notches in the outer perimeter of the flywheel, and the key 148C securing the flywheel to the camshaft 163. Also shown in dotted lines is the position of the stop notches 148B on the back side of power flywheel 146A, set 120° apart.

Figures 15, 16, 19, 20, 21, 22, 23:
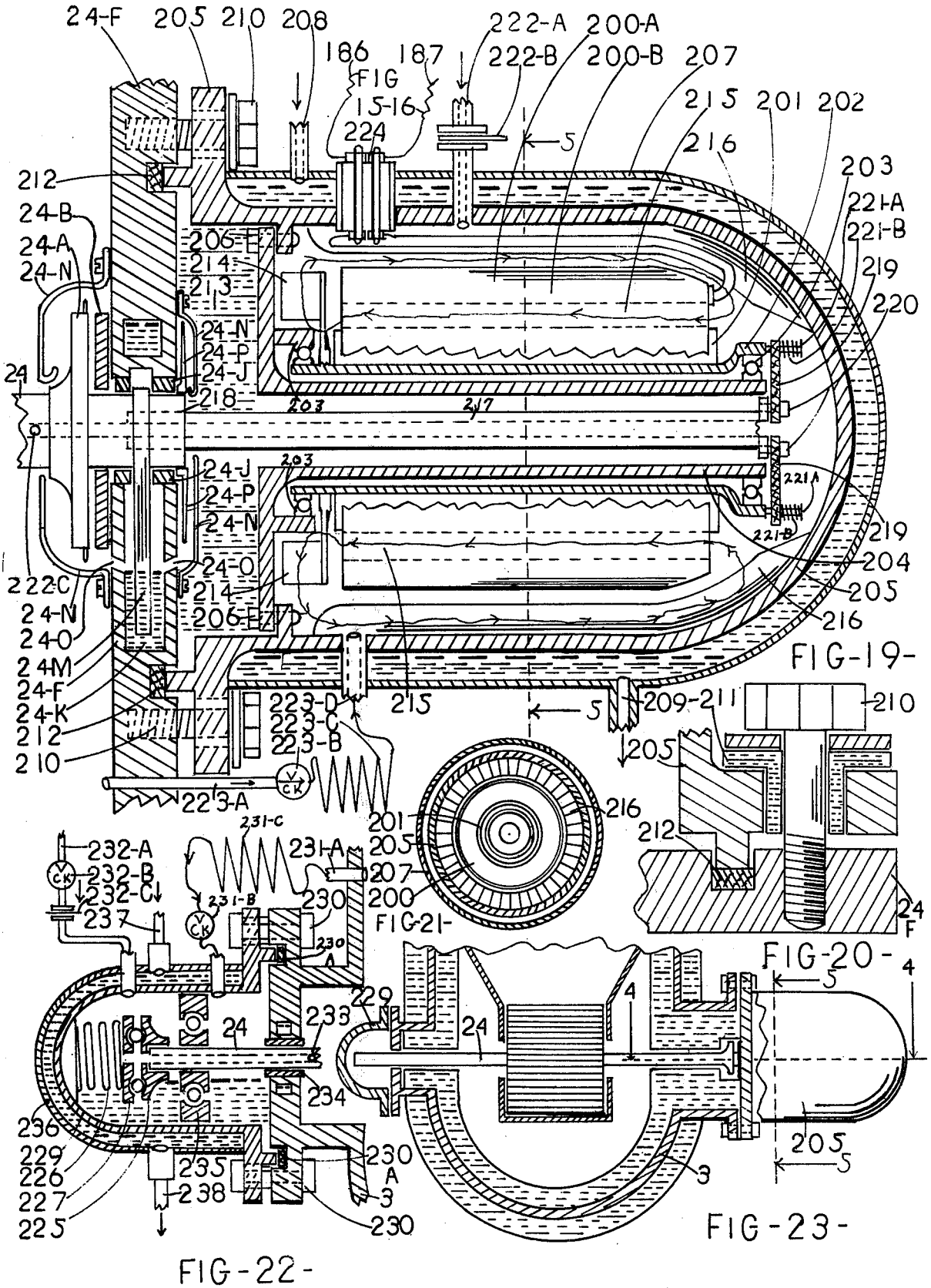
FIG. 15 is a plan view of the single pole, spring release switch in the fuel injector cabinet, which starts the motor 24-P, FIG. 1, or motor 200-A, FIG. 19, thereby driving the circulation fan located inside each pressure generator.

FIG. 15 shows an enlarged view in elevation of the spring release electric switch 178. The cam E, FIGS. 11 and 16, actuates rocker arm 179, FIGS. 15 and 16, from PO-1 to PO-2 by striking roller 181 on electric contact arm 180, moving arm 180 from PO-1 to PO-2. This movement brings electric contact point 183 on arm 180 into contact with electric contact point 184 mounted on contact arm 185. Both electric contact points 183 and 184 are insulated from arms 181 and 185, but are electrically connected to electric wires 186 and 187 which, via electric wires 186 and 187, connects electric source 176 to the fan motor magnetic clutch 24G on fan motor 24P, FIG. 1 or fan motor number 200, FIG. 19. On the pressure generator whose switch is closed, there would be a switch 178 in each fuel injector box. There is a separate fuel injector 170, FIGS. 10, 11 and 16, for each of the pressure generators 1, 2, and 3. In FIG. 15, both contact arms 180 and 185 are mounted on pivot tunnion 182, and contact arm 185 is mounted next to the support plate 178B, and has an offset part 188 which raises the contact point 184 up in line with contact point 183. On contact arm 185, spring 189 pressures arm 185 toward short stop pin 190, which stops contact arm at PO-1. Spring 191 pressures contact arm 180 toward tall stop pin 192 which stops contact arm 180 in PO-1, thus, the spring release switch 178 is closed as soon as cam 180, FIG. 16, strikes arm 179, moving arm 179 from PO-1 to PO-2, and the switch remains closed and fan 24, FIG. 1, runs the entire burn period to furnish combustion air to the burners and dilution air into the hot gases from the burners to dilute the hot gases to workable temperatures.

FIG. 16 shows an enlarged side view in elevation of the fuel injectors 170. There is one 170 fuel injector to each pressure generator. The injector actuating cam is 180, designated as E in FIG. 11. Cam follower arm 179A pivots on tunnion 179B, which is secured to supporting frame 193. Cam follower arm 179A is held against cam 180 by spring 179C. When cam 180 moves cam follower 179A down from PO-1 to PO-2, the left hand end engages roller 181B, pushing it into PO-2, which closes spring release switch 178, and starts fan 24 in the pressure generator controlled, as described under FIG. 15.

Swinging arm 194A is mounted on supporting frame 193 directly below cam follower arm 179A and pivots on tunnion 194B, which is secured to supporting frame 193. Arm 194A is pressured upward by spring 194C, arm 194A has a swinging variable control arm 194D hinged to arm 194A by pin 194E extending upward and bearing against an arc 179D formed in the bottom side of cam follower cam 179A. The air pressure inside the pressure generator actuates pressure expansion tube 195A, which is secured by bracket 195B to supporting frame 193 and is connected to pressure connection 158, FIG. 5. The free end of tube 195A has a bearing sleeve 195C welded to the closed end. This is connected to the left arm of quadrant 195E by connecting rod 195D. The right arm of quadrant 195E is connected to swinging arm 194D by connecting rod 195G. If there is little or no pressure in the pressure generator, then expansion tube 195A is in PO-1. This would place variable control arm 194D in PO-1, where the motion of arm 179A, from PO-1 to PO-2, would not be transmitted to swinging arm 194A. With full pressure on the pressure generator, expansion tube 195A would be extended to PO-2. This movement is transmitted to control arm 194D by the linkage described, and places control arm 194D in PO-2 so that more than the full motion of arm 179A would be transmitted to arm 194A. Fuel pump actuating arm 196A is mounted on supporting frame 193 directly below swing arm 194A and pivots on tunnion 196B, which is secured to supporting frame 193. Arm 196A is pressured upward by spring 196C. Arm 196A has a swinging variable control arm 196D hinged to arm 196A by pin 196E extending upward and and bearing against an arc 196G formed by the bottom side of swing arm 194A.

Thermostatic element 36, FIGS. 1 and 5, inside the pressure generator is filled with gas or air connected to the thermostatic heat limit 155, FIG. 5, by pipe 156, which is connected to expansion tube 197A that is calibrated to be in PO-1 when the air inside the CPPG is cold. When the air within the CPPG reaches the predetermined temperature, the heat expands the air or gas within the thermostatic element 136, extending pressure on expansion tube 197A, and, via connecting rod 197F, moves variable control arm 196-D to PO-2, thereby cutting the stroke of fuel pump to zero, effectually limiting the temperature within the CPPG.

The expansion tube 197A, FIG. 16, can be used to actuate a cutoff switch closing block valve 161, thereby, cutting off the fuel to the burners via wire 159F, FIG. 5.

The expansion tube 195A, FIG. 16, can be used to actuate a cut-off switch closing block valve 161 if the air pressure in the pressure generator is below a predetermined pressure via wires 160, FIG. 5, and battery 160-A. The method of control shown in FIG. 5 can be used as an alternate to the controlls shown in FIG. 16 as a means to control the fuel flow to the burners.

Fuel pump 198A has a fuel inlet 198B which is connected to source of fuel under a low pressure with check valve 198C, outlet opening 198D with check valve 198E connects to mechanical pressure accumulator 198F with an orifice 198G in the outlet 198-H which goes to the burner in the pressure generator. Piston 199A fits with a fluid tight sliding fit into fuel pump body 198A and is pressured upward against fuel pump actuating arm 196A by spring 199B and limited to travel upward by restraining arm 199C.

Thus on starting up cold, the pressure from the air accumulators is, for example, 600 PSI on the pressure generator, and expansion tube 195A is extended to PO-2, and variable control arm 194D is in PO-2 giving swinging arm 194A a full stroke. Temperature within the pressure generator is low, so expansion tube 197A is in PO-1, which puts variable control arm 196D in PO-1, giving a full stroke to fuel pump plunger 199A. When the temperature rises to the predetermined temperature in the pressure generator, the expansion tube expands, cutting down on the fuel to limit the temperature.

FIG. 17 shows a side view in elevation of the ratio adjustment on quadrant 195E, and the length of adjustment on connecting rod 195G. FIG. 18 shows a plan view of FIG. 17. Rod 195G has a pinned collar 195N which retains coil spring 195K against pivot collar 195-I and sleeve 195-O and wing nut 195-J, which engages the threaded end of connecting rod 195G. The pivot collar 195-I has a pivot stud that extends through slide 195-L with a retaining nut, allowing connecting rod 195G to be shortened or lengthened by turning wing nut 195-J.

FIG. 17 shows the vertical "in ratio adjustment" on quadrant lever 195E. Extended collar 195-P is pinned to lever 195-E and has a bolt through the end of adjustment screw 195M. The spring 195-S pushes against collar 195-P and against slide 195-L, which straddles the flat slotted end of lever 195-E. Collar 195R extends against slide 195L and the wing nut 195-T, which engages the threaded end of adjustment rod 195-M, which passes through the right hand side of slide 195-L as shown. This same means of adjustment is used in lever 197-E and connecting rod 197-F, not shown. Thus, an exact adjustment in both air to fuel ratio and temperature limit can be easily made.

An alternative construction for a electric motor drive for the fan 24, shown in FIGS. 1, 3 and 5, is shown in FIGS. 19, 20, 21, 22 and 23. Briefly, this consists of an electric motor to drive the fan, which is housed in a pressure tight bell housing which has an equalizing conduit communicating with the combustion products generator pressure vessel. The equalizing conduit passes through a cooling coil, so that the air entering the bell housing is cool. This construction equalizes the pressure on both sides of the mechanical seal, making possible the use of a minimum axial thrust between the two sealing discs required to obtain a pressure tight seal for the shaft where it passes through the outer wall of the pressure generator vessel wall,. This insures a long life for the mechanical seal.

FIGS. 19,20,21,22 and 23 show the detailed construction of an electric motor drive for the drive shaft of circulating fan 24 shown in FIGS. 1,3 & 5. FIG. 19 is a sectional view in elevation on section lines 4–4 of FIG. 23. The electric motor is 200-A, the armature 201, the hollow armature shaft 202, which is supported by sealed ball bearings 203—203 on tublar support bracket 204, which is secured to bell shaped pressure housing 205 by cap screws 206—206. The pressure holding housing 205 is surrounded by a cooling medium jacket 207 with outlet 209 and inlet 208. The pressure holding housing 205 is secured to removable head 24-F, FIG. 3, by cap screws or stud bolts 210, which are insulated from the pressure housing 205 by insulating gasket 212 and by insulating material bushings 211, FIG. 20. The pressure holding housing 205 is clamped against insulating gasket 212, FIGS. 19 and 20, and insulation 213, FIG. 19.

Circulating fan 214 is secured to and turns with motor armature 201. This fan circulates the air within the pressure housing, through the air passage ways 215 in the field windings and armature windings, and passes over cooling coils or fins which are attached to the inside of the pressure holding housing 205, shown in FIGS. 19 and 21.

The cooling fins will transfer the heat from the air to the pressure holding housing to the cooling medium in the cooling jacket 207.

The drive shaft from the motor to fan shaft 24 is 217, FIG. 19. It is splined on the left hand end at 218 and slips into a matching splined recess in the end of shaft 24. The right hand end is secured to flexible drive disc 219 by cap screws 220. The outer edge of flexible drive disc 219 is secured to hollow armature shaft 202 by pins 202 by pins 221-A which are equipped with spring retainers 221-B. This construction gives some flexibility to the drive line from the motor to fan shaft 24 to allow for possible slight misalignment caused by heat expansion. The flexible drive disc is made of insulating material to prevent heat from transferring from drive shaft 217 to hollow armature shaft 202, FIG. 19. Drive shaft 217 is rifled drilled for passage of the cool blocking air which flows through hollow shaft 217 and into fan shaft 24, through the drilled center opening and out of outlet opening 222-C. This flow of cool air cools the end of shaft 24, seal disc 24-A and bearing 24-J, and excludes the hot gases from the seal area. The cooling passes around shaft 24, and into pressure generator interior.

The high pressure cool blocking air enters the pressure housing through connection 222-A, FIG. 19. The volume is controlled by orifice plate 222-B and a conventional passage regulator at a predetermined pressure and rate of flow.

The pressure equalizing conduit from the pressure generator pressure vessel to the pressure holding housing is 223-A, and the check valve is 223-B. The cooling coil is 223-C, and enters the pressure holding housing through connection 223-D. The electric power supply to the electric motor is through pressure-tight terminal 224 and electric wires 186 and 187. (See FIGS. 15 and 16 and switch 178. This type fan motor drive is an alternate species of motor 24-P, FIGS. 1 & 15.

Fan shaft 24 extends through removable head 24-F FIGS. 1, 3 and 19, and is supported by bearing 24-J. Fan shaft 24 has a hard polished faced seal flange 24-A secured pressure tight on said fan shaft, bearing against a softer anti friction material seal flange 24-B, which is secured to the left hand face or pressure side of removable head 24-F, FIGS. 3 and 19. A removably secured second flange means 225 (FIG. 22) on the left hand end of said fan shaft, facing away from said head, and a second flange means 227 comprise a thrust bearing means secured to said shaft and spring bias means 226 in provided to bias said thrust bearing means 227, producing an axial thrust on said shaft to move the hard polished seal flange 24-A into a rotating, slidable, pressure-sealing contact with said matching seal flange 24-B.

The bearing 24J and the seal flanges are lubricated by oil carried up from oil resevoir 24-K by oil ring or chain 24-M, which rests on the fan shaft 24 and is rotated with shaft 24. Oil ring 24-M has a much larger inside diameter than the outside diameter of shaft 24, so it revolves at a much slower speed and carries the oil up from oil reservoir 24-K into bearing 24-J. The excess oil will run out the ends of bearing 24-J, lubricating the seal flanges 24-A and 24-B. The excess oil from the seal flanges 24-A would be thrown off by centrifugal force against oil retainers 24-N, which will then run down through drain holes 24-O into oil resevoir 24-K. The excess oil that drains out the right hand side od bearing 24-J would be thrown off by coil slinger flange 24-P, which revolves with shaft 24 against oil retainer 24-N, which will then drain down into oil resevoir 24-K through drain holes 24-O to be used again.

In FIG. 22, the removeable bell housing 229 is held pressure-tight against the combustion products pressure vessel 3 by bolts 230 gasket 230-A. The cooling medium jacket is 236, the cooling medium inlet is 237, and the outlet 238. The equalizing conduit between the combustion products pressure vessel and the bell housing is 231-A, with check valve 231-B, and cooling coil 231-C. The blocking air inlet is 232-A, the check valve is 232-B, and the orifice flange 232-C.

The left-hand end of fan shaft 24 is rifle drilled for the excess blocking air to escape through operative 233 and around bearing 234, thus excluding the hot gases of combustion from the area of thrust bearing 225 and the radial bearing 235. The level of the lubricating oil is shown as a liquid level which would effectually lubricated the thrust bearing 225 and radial bearing 235.

FIG. 21 is a cross section end view in elevation on section lines 5—5, FIGS. 19 and 23, of the electric drive motor 200-A, pressure holding housing 205, and cooling medium jacket 207.

FIG. 23 is a schematic part in section view of the lower part of the pressure generator pressure shown in FIGS. 1, 3, 21 and 22, to show the general arrangement of the various elements.

A second species of the electric motor cooling arrangement would be to substitute a coil of pipe inside the pressure holding housing for the cooling medium to flow through and the air within the pressure holding housing to be circulated around to cool the air.

A third species could be cooling fins attached to the pressure holding housing inside and outside to convey the heat from the motor to the outside air.

A second species of mechanical seal on the fan shaft between the combustion products generator and the motor housing could be carbon seal rings with spring tension bands, and with cooling jackets around the carbon seal rings to prevent dis-tempering the springs.

The possible applications of the described combustion products pressure generators are very versatile. Engines using pressure generators can be built in many types and sizes, using the type compressor suitable for use with the type engine or turbine it is designed to be used with. They may be designed for the type fuel they are to be used with. They can be built for a charge pressure from 50 PSI up, and, theoretically, the higher the charge pressure, the greater efficiency. The pressure and temperatures used can be suited to the use of the engine or turbine, the fuel used and the conditions operated under.

With the foregoing and other objects in view, the invention resides in the novel arrangement and combination of parts and in details of construction hereinafter described and claimed, it being understood that changes in the precise embodiment of the invention herein disclosed may be made within the scope of what is claimed without departing from the spirit of the invention. Therefore, the invention is not limited by what is shown in the drawings and described in the specification but only as indicated by the appended claims.

What I claim and desire to secure Letters Patent of the United States of America is:

1. An intermittent cycle, two stage combustion products pressure generator, consisting of a constant volume combustion chamber which is a pressure vessel, burner means located inside said combustion chamber said burner means comprising a fuel burner having an inlet end and an outlet end, and a bypass means for passage of dilution air around said fuel burner, said bypass means communicating with said fuel burner proximate said outlet end of said fuel burner a means to inject atomized fuel into said fuel burner, an ignition means in said fuel burner to ignite said fuel, air inlet means to said combustion chamber a means of forced circulation of part of the air within said combustion chamber through said fuel burner for combustion air, consisting of a fan means in communication with said burner means, driven by a means outside said combustion chamber, part of the air flow discharged from said fan directed through said fuel burner for combustion air, part of the air flow discharged from said fan directed into said bypass means, wherein said dilution air mixes with and cools the gases from said fuel burner to workable temperatures, said burner means and pressure vessel made of heat resistant materials, said air inlet means to said combustion chamber connected to a source of air under pressure, a low pressure outlet in said combustion chamber, a high pressure outlet opening in said combustion chamber, a low pressure discharge and a high pressure discharge valve on each of the respective low pressure and high pressure onto openings to control the flow there through, a means to operate the valves, fuel injection and ignition in timed sequence in each cycle of said pressure generators so as to deliver the hot pressure fluid medium produced in said pressure generator at the time and in the volume required.

2. A combustion products pressure generator consisting of a constant volume combustion chamber having an outside shell which is a pressure vessel, an insulating lining inside the outside shell of said combustion chamber, a protective lining of heat resistant material, inside said insulating lining of said combustion chamber, burner means located inside said combustion chamber, said burner means comprising an elongated tubular member open at both ends, a tubular jacket of larger diameter than said tubular member, and surrounding said tubular member and secured in air tight relationship at the outlet end of said tublar member, said tubular jacket defining an annular duct between said burner means and said tubular jacket, both members made of heat resistant material, fan means driven by a shaft from a means outside of said combustion products generator, the discharge from said fan is directed into said burner means and said annular duct, said tubular jacket having aperatures near the outlet end of said burner in communication with said tubular member to discharge cooler air into the hot gases of combustion from the tubular member, cooling and diluting said gases to workable temperatures, a means to inject atomized fuel into said tubular member, an ignition means in said tubular member to ignite said fuel, an outlet opening in said combustion chamber, a valve to control the flow there through, an inlet opening to said combustion chamber, a valve to control the flow there through, said inlet opening connected to a source of air under pressure, and to said fan means a means to operate said valves, fuel injection and ignition in timed sequence in each cycle of said combustion products pressure generators so as to deliver the hot pressure fluid medium produced in said combustion products pressure generator at the time and in the volume required.

3. A combustion cycle for a plurality of two stage combustion products pressure generators employed in multiples of three, having an intermittent heating cycle, each pressure generator having a combustion air inlet opening, a combustion air inlet valve to control the flow there through, a low pressure discharge outlet opening, a low pressure discharge valve to control the flow there through, and a high pressure discharge outlet opening, a high pressure discharge valve to control the flow there through, a control system which operates the valves, fuel injection and ignition in three intermittent steps, and a fan means within the pressure generator, a method of operating each of said combustion products pressure generators in three sequential steps comprising; step

4. A method for a combustion cycle for a two stage combustion products pressure generator, of the constant volume type, consisting of a combustion chamber which is a pressure vessel having burner means located inside said combustion chamber consisting of a elongated tubular member open at both ends, a tublar jacket of larger diameter than said tubular member, and surrounding said tublar member, and secured in air tight relationship at the outlet end of said tublar member, both tublar members made of heat resistant material, said tublar member lined with a high temperature refractory lining sectionlized for heat expansion means to inject fuel into said tubular member, ignition means in said tubular member, air inlet means to said combustion products pressure generator, air circulation means in communication with said tubular member to effect forced circulation of air through said tubular member at a rate such that the injected fuel is vaporized and ignited and combustion is essentially completed within said tubular member, said air circulation means additionally in communication with said tubular jacket, apertures in said tubular jacket proximate the outlet end of said tubular member to effect discharge of air from said tubular jacket into the hot gases from said tubular member dilute and cool said hot gases to a workable temperature.

5. A combustion products generator as described in CLAIM NUMBER 1, a rotating shaft connecting said drive means and said fan means a pressure seal system between said rotating shaft and the exterior wall of said pressure vessel comprising a flanged opening in said pressure vessel, a matching head forming an exterior wall of the flanged opening and connected to said pressure vessel, an aperture in said head for said shaft to pass through, a rotatable fit bearing attached to said head to carry said shaft, a hard polished seal flange secured to and rotating with said shaft on the interior of, and adjacent to, and facing said head, a matching seal flange around said shaft, of softer antifriction material secured to the inside of said head and adjacent to said hard polished seal flange, a removably secured second flange means on said shaft on the exterior of, adjacent to, and facing said head, said second flange means comprising thrust bearing means secured to said shaft, and spring bias means to bias said thrust bearing means, producing and axial thrust on said shaft to move hard polished seal flange into rotating, slideable, pressure sealing contact with said matching seal flange, a stationary enclosure around said seal flange, removably attached pressure tight to the interior of said removable head and having an outboard bearing of antifriction material for the shaft on the interior and adjoining the pressure chamber, rotatably fitted to the shaft, a conduit from the exterior of the pressure vessel in communication with said stationary enclosure consisting of means to supply needed quantity of cool high pressure air to said stationary enclosure to cool the seals and exclude hot pressure fluid medium from the seal area within said tubular enclosure, vent apertures in said pressure vessel in communication with said stationary enclosure to enable passage of the cooling air into said pressure vessel.

6. A combustion products generator consisting of a combustion chamber which is a pressure vessel having an outer wall, and fuel burner means located inside said combustion chamber, a means to inject atomized fuel into said burners means, an ignition means in said burner means to ignite said fuel air inlet means to said combustion chamber forced circulation of part of the air within said combustion chamber through said burner means for combustion air, consisting of fan means driven by a drive means from outside said combustion chamber pressure vessel, part of the air flow discharged from said fans means directed through said burners for combustion air, part of the air flow discharged from said fan to be directed into the hot gases from said burners to mix with, dilute and cool a shaft passing through said outer wall and connecting said drive means and said fan means, bearing means for said shaft, a mechanical seal on said shaft where it passes through the outer wall of said pressure vessel, said drive means comprising, an electric motor connected to said shaft, said motor located outside the pressure vessel, a pressure tight housing enclosing said electric motor, a means of equalizing the pressure between said combustion products pressure generator pressure vessel and said pressure tight housing enclosing said electric motor, whereby the pressure is equalized on both sides of said mechanical seal insuring a larger effective life for said mechanical seal.

7. A combustion products generator as described in claim 6, and further comprising a means to cool said enclosed electric motor comprising a second housing surrounding said pressure tight housing, and a means to supply a cooling medium to said second housing.

8. A combustion products generator as described in claim 6, wherein the pressure equalizing means comprises means to admit pressurized air to said pressure tight housing, and means to allow limited passage of said pressurized air around said mechanical seal and into said combustion products pressure generator.

9. A combustion products generator as described in claim 6, pressure vessel of the said electric motor comprising means to isolate and insulate said electric motor from the heat radiating from said combustion products generator.

10. A combustion products generator as described in claim 6, and further comprising a means to cool and lubricate the bearings and said mechanical seal means on said shaft means connecting said fan means and said drive means.

11. A combustion products generator as described in claim 6, said fan shaft comprising an outboard bearing housing which encloses a radial bearing and axial thrust means and bearing on the opposite end from the driver means, a means to exclude the heat from the combustion products pressure generator from said bearing housing, a means to cool said bearing housing and lubricate said bearings, comprising an insulating means, a cool air blocking system, and a cooling means for said bearing housing.

12. A an intermittent cycle two stage combustion products generator as described in claim number 1 and further comprising a means to cutoff the flow of fuel to said burners upon a failure of said ignition means.

13. A an intermittent cycle two stage combustion products generator as described in claim number 1, and further comprising, a means to limit the amount of fuel injected into the burners in ratio to the air pressure in said combustion products pressure generator.

14. A combustion products generator consisting of a combustion chamber which is a pressure vessel, fuel burner means located inside said pressure vessel, circulating fan means located inside said pressure vessel, said fan means driven by a shaft by a means outside said pressure vessel, said pressure vessel to have a large removable head on one side of the lower end, said fan shaft to extend at right angles to the face of said removable head and extend through a aperture in said head, the upper three quarters of the burner means supported by a frame work with the supporting posts resting on insulation in the bottom of said pressure vessel, said supporting posts placed to the left and right sides of the length of the fan shaft leaving a corridor between the posts the width of the fan housing, said fan housing and lower quarter of burners including fuel nozzles, ignition means, combustion and dilution air controlls to be mounted on a frame work secured to said removable head in such a manner that when said removable head is released from said pressure vessel the above described assembly slips out of the pressure vessel like a drawer, readily accessable for adjustment, maintenance and repair.

15. The method of claim 4, and further comprising sensing the pressure of the high pressure discharge from the combustion products pressure generator operating in step three, and blocking said switching signal until both the measured volume of air supplied to the combustion products pressure generator operating on step one reaches said predetermined value, and the pressure of the high pressure discharge from the combustion products pressure generator operating in step three has dropped below a predetermined value.

16. A combustion cycle for a plurality of two stage combustion products pressure generators operated in multiples of three, and having an intermittent heating cycle, each pressure generator having a combustion air inlet opening, a combustion air inlet valve to control the flow therethrough, a low pressure discharge outlet opening, a low pressure discharge valve to control the flow therethrough, and a high pressure discharge outlet opening, a high pressure discharge valve to control the flow therethrough, a control system which operates the valves, fuel injection, and ignition in three intermittent steps, and a fan means within said pressure generator for forced circulation of air within said pressure generator, a method of operating each of said combustion products pressure generators in three sequential steps comprising; step one; closing the high pressure discharge valve and opening both the air inlet valve and the low pressure discharge valve, wherein air through the inlet valve forces exhaust gases through the low pressure discharge valve to perform useful work, and fills the pressure generator with fresh combustion air; step two: closing the low pressure discharge and air inlet valves, starting the fan means, injecting a metered amount of fuel into the combustion products pressure generator, igniting the fuel and air, and combusting the fuel and air over a period of time; step three: opening the high pressure discharge valve, stopping the fan means, thereby releasing high pressure combustion gases to perform useful work; wherein each combustion products pressure generator is operated in continuous sequential order from step one to step two to step three, and back to step one, and each combustion products pressure generator is maintained on a separate step; and further comprising sensing the discharge pressure of the high pressure discharge gases of the combustion products pressure generator operating on step three, generating a switching signal when said discharge pressure drops below a predetermined pressure, and effecting sequential changing of each combustion products pressure generator to the next step in response to said signal.

17. The combustion products pressure generator of claim 1, and further comprising an outside shell for said pressure vessel, an insulating lining inside the outside shell, and a protective heat resistant material lining inside said insulating lining.

18. The method of claim 3, and further comprising the step of limiting the amount of fuel injected into the combustion products pressure generator in ratio to the air pressure in said pressure generator.

19. The method of claim 3, and further comprising measuring the temperature within the combustion products pressure generator, and terminating the flow of fuel injected into the combustion products pressure generator when a predetermined temperature is reached.

* * * * *